US006731222B2

(12) United States Patent
Martineau

(10) Patent No.: US 6,731,222 B2
(45) **Date of Patent: *May 4, 2004**

(54) SUN PHANTOM LED TRAFFIC SIGNAL

(75) Inventor: Patrick Martineau, Montreal (CA)

(73) Assignee: Gelcore LLC, Valley View, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/150,052

(22) Filed: May 16, 2002

(65) Prior Publication Data

US 2002/0186143 A1 Dec. 12, 2002

Related U.S. Application Data

(63) Continuation of application No. 09/756,670, filed on Jan. 10, 2001, now Pat. No. 6,509,840.

(51) Int. Cl.[7] ..... G08B 5/22
(52) U.S. Cl. ..... 340/815.45; 340/907; 362/800
(58) Field of Search ..... 340/815.45, 907, 340/463, 468; 362/800

(56) References Cited

U.S. PATENT DOCUMENTS

| | | | | | |
|---|---|---|---|---|---|
| 4,733,335 | A | * | 3/1988 | Serizawa et al. | 362/800 X |
| 5,046,818 | A | * | 9/1991 | Barnes | 359/527 |
| 5,408,232 | A | * | 4/1995 | Tsai et al. | 340/907 |
| 6,019,493 | A | * | 2/2000 | Kuo et al. | 362/800 |
| 6,509,840 | B2 | * | 1/2003 | Martineau | 340/815.45 |

* cited by examiner

*Primary Examiner*—Thomas J Mullen, Jr.
(74) *Attorney, Agent, or Firm*—Orum & Roth

(57) ABSTRACT

A light emitting diode signal with reduced susceptibility to the "sun phantom" effect. A single printed circuit board populated with both the power supply circuitry and the light emitting diodes is located at an increased distance from the front cover which is angled to direct extraneous light away from the viewers position. A snap together housing reduces overall cost and assembly time. Light from the light emitting diodes distributed across the single printed circuit board to project an overlapping light pattern is collimated by a multiple collimating zone optical element which creates a uniform display aspect without discernable individual points of light.

20 Claims, 13 Drawing Sheets

SUN PHANTOM LED TRAFFIC SIGNAL

This application is a continuation of U.S. application Ser. No. 09/756,670 filed Jan. 10, 2001, now U.S. Pat. No. 6,509,840.

BACKGROUND OF THE INVENTION

The present invention relates to signals, in particular, Light Emitting Diode (LED) Signals. More specifically, the present invention relates to an LED traffic signal that is less susceptible to the "sun phantom" effect, having an improved viewing aspect, as well as materials, manufacturing and installation cost advantages.

DESCRIPTION OF THE RELATED ART

LED traffic signals present numerous advantages over common incandescent lamp traffic signals. Use of LED's provides a power consumption savings and extremely long life in comparison to common incandescent light sources. The long life span creates improved reliability and sharply lowered maintenance costs.

As an individual LED is not bright enough to equal the light output of an incandescent lamp, multiple LED's are used. Previously, multiple LED's created a display aspect with multiple individual points of light readily discernible by the viewer. A non-uniform display aspect is commercially undesirable for traffic signals. One method of preventing discernable individual light points has been to use a full array of LED's. However this is not commercially competitive as each additional LED is a significant percentage of the signals total cost. Each generation of LED's is becoming brighter and brighter requiring fewer and fewer LEDs to equal the light output of an incandescent lamp but at the same time increasing the likelihood that the individual point sources and/or shadows between each LED are then detectable by the viewer.

Due to the large installed base, worldwide, of incandescent traffic signal systems, most LED traffic signals are designed to be retrofitted into existing traffic signal systems originally designed for incandescent lamps. To allow an easy retrofit to an LED light source, without requiring large changes to existing intersection alternating current power distribution and logic circuits, signal assemblies incorporate a power supply to drive LED's at a lower, controlled, direct current power level. In the past, this has resulted in an LED traffic signal assembly with a separate power supply built on a Printed Circuit Board (PCB) and a separate LED matrix PCB connected via wiring between the two PCB's as well as spliced into the original incandescent power wiring. Integration of LEDs onto a single PCB including the power supply results in a smaller PCB with corresponding manufacturing and cost of materials benefits.

Cost of materials and assembly time contribute to total cost and therefore to commercial success. Previous LED traffic signals used a large number of total components, each individual component adding material cost, assembly cost and introducing a potential quality control, moisture, and/or vibration failure opportunity.

Traffic signals are susceptible to "sun phantom" phenomena. When a light source, for example the sun, shines upon the face of a traffic signal, a bright spot, or worse, internal reflection from within the signal, may make it appear to a viewer that the signal is energized when, in fact, it is not, leading to an increased chance for accidents.

Previous incandescent signals have attempted to prevent the "sun phantom" phenomena by using a visor, internal or external baffles and/or a flat outer face angled towards the ground. Visor's and external baffles limit the viewing angle of the signal. Internal baffles add cost to the signal by introducing an element that has no other purpose. Flat outer faces are not allowed, according to some traffic signal specifications which require a spherical front element.

Previous LED signal lamps are especially susceptible to "sun phantom" phenomena because the rear surface of each LED is highly reflective. Previous LED signal designs located the LED's on or close to the outer surface where the rear surface of each LED could easily be reached by stray light, creating an increased opportunity for "sun phantom" reflections.

Therefore, the present invention has the following objectives:

1. An LED signal which minimizes the problem of "sun phantom" erroneous signal aspects.
2. An LED signal which presents a uniform brightness display aspect equal to or better than a common incandescent lamp traffic signal.
3. An LED signal that has materials and manufacturing assembly cost advantages.
4. An LED signal comprised of a single printed circuit board carrying both the LED's and the power supply components.
5. An LED signal retro-fitable into existing incandescent traffic signals, without requiring removal of the existing reflector assembly.
6. An LED signal capable of easy upgrade to higher output LEDs without requiring recalculation of the optical elements.
7. An LED signal with a display aspect unaffected by changes in individual LED light output.
8. An LED signal usable in multiple configurations, each specific to a given application, with a minimum of unique components being required.

Further objects will be realized by one skilled in the art, through review of the following description and appended claims.

SUMMARY OF THE INVENTION

The above objects and other advantages are achieved with the present invention. Placement of the LEDs, to create an overlapping light emission pattern at an increased distance from a Multiple Collimating Zone Element (MCZE) creates a uniform display aspect for the signal, without individual points of light. The increased distance also allows placement of power supply components and circuitry on a single PCB with the LEDs, spaced so as to prevent interference with the LED light. The "sun phantom" phenomena is prevented by a large radius spherical outer distribution cover, angled to reflect stray light away from the viewer, towards the ground. A complex inner surface on the distribution cover creates a shaped light distribution, focused upon the viewer, while at the same time further directing stray light reflections, again, towards the ground. Materials, assembly and installation cost efficiencies are realized by a novel snap together housing design which adds to an overall reduction in total number of components. The signal fits into existing standard incandescent traffic signals upon removal only of the incandescent bulb and original outer lens. Electrical connection is made by merely screwing a socket mating connector into the existing incandescent socket.

DETAILED DESCRIPTION

Figure 1:
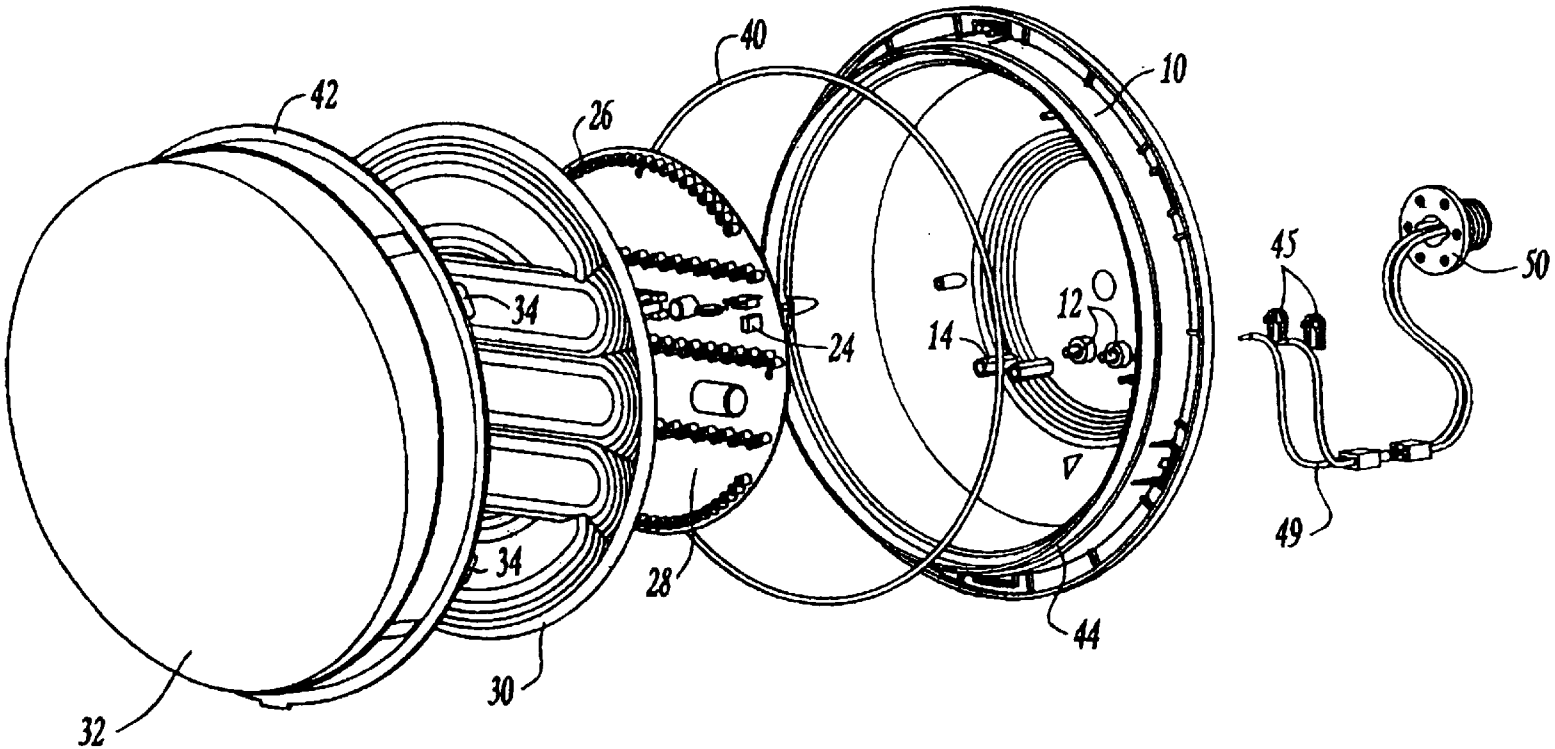
FIG. 1 is an exploded view showing the major components of the 12" linear MCZE embodiment of the invention.

Referring to FIG. 1, the main components of a 12" traffic signal embodiment of the invention are visible. A housing 10 holds the components of the traffic signal. The housing 10 may be formed from, for example, polycarbonite material. Polycarbonite material having excellent strength and impact resistance characteristics. Formed into the base of the housing 10 are metal power terminals 12. The metal power terminals 12 have exposed threaded posts on the internal side upon which a power connector spacer may be attached. The PCB 28 is attached to the power connector 14 with screws. The PCB 28 has mounted upon it a pattern of LEDs 26. The LEDs 26 are arranged in horizontal rows. Between the rows are arranged the power supply components 24. The power supply components 24 are arranged in a way that minimizes the interference with the light emitted from the LEDs 26. The PCB 28 fits into the housing 10 via mounting posts 20 and is fixed in place with screws. To allow as large a PCB 28 as possible, thereby allowing a larger distribution of LEDs 26, the PCB 28 is angled within the housing 10. The mounting posts 20 orient the PCB 28, precisely aligning the LEDs 26 of the PCB 28 with respect to the MCZE 30 into parallel planes. The MCZE 30 is oriented with respect to the housing 10 by placement upon the top surface of the housing 10 upon which it is retained by mounting posts on the housing 10 and distribution cover 32.

Figure 2:
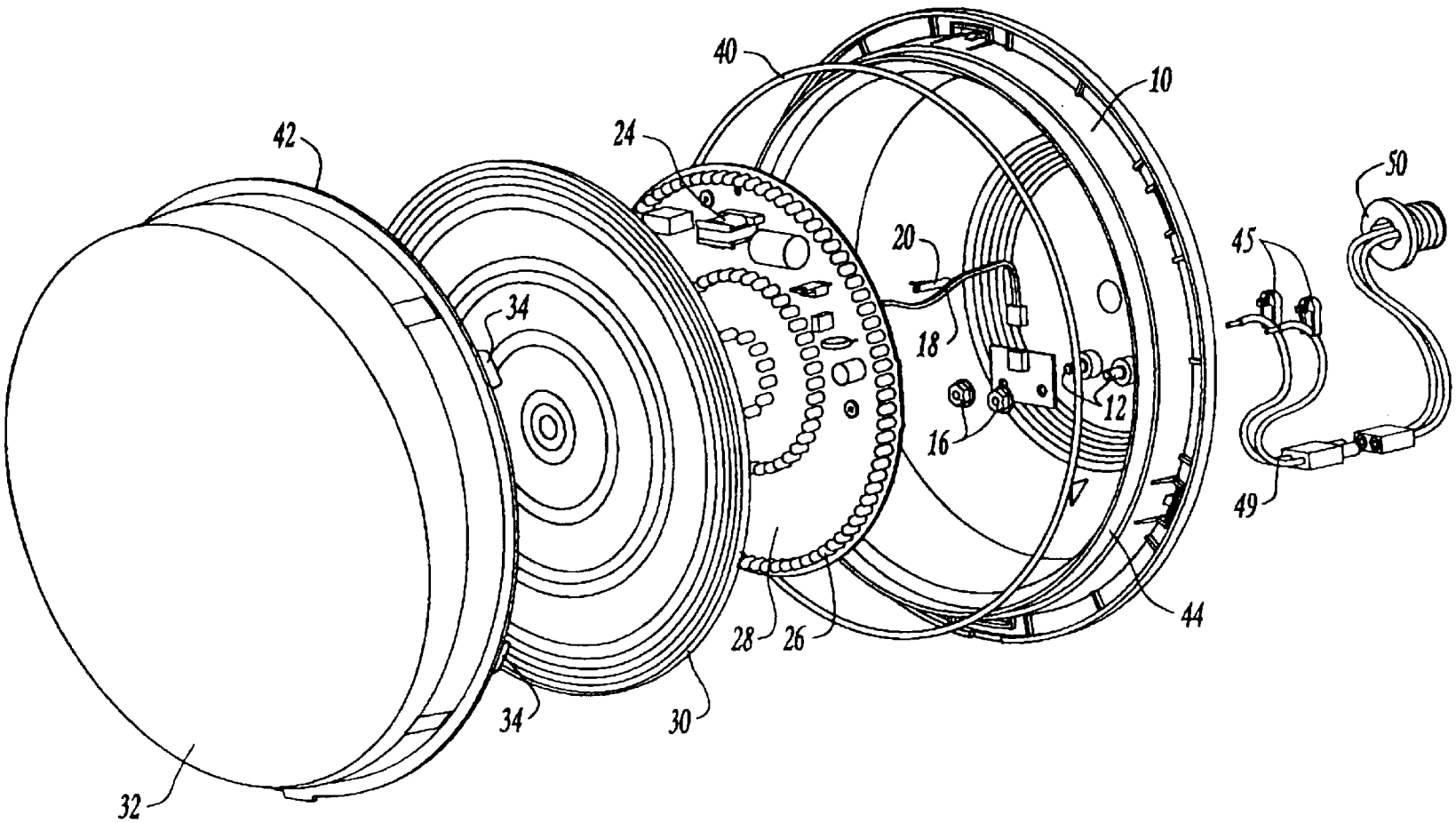
FIG. 2 is an exploded view showing the major components of the 12" circular MCZE embodiment of the invention.

The MCZE 30 may also be formed in, for example, a circular, or horizontal/vertical linear configuration. An embodiment with a circular MCZE 30 is shown in FIG. 2. Here, the PCB 28 is powered via a power connector cable 18 which connects to a power connector board 14, mounted on the metal power terminals 12 using nuts 16.

Figure 4:
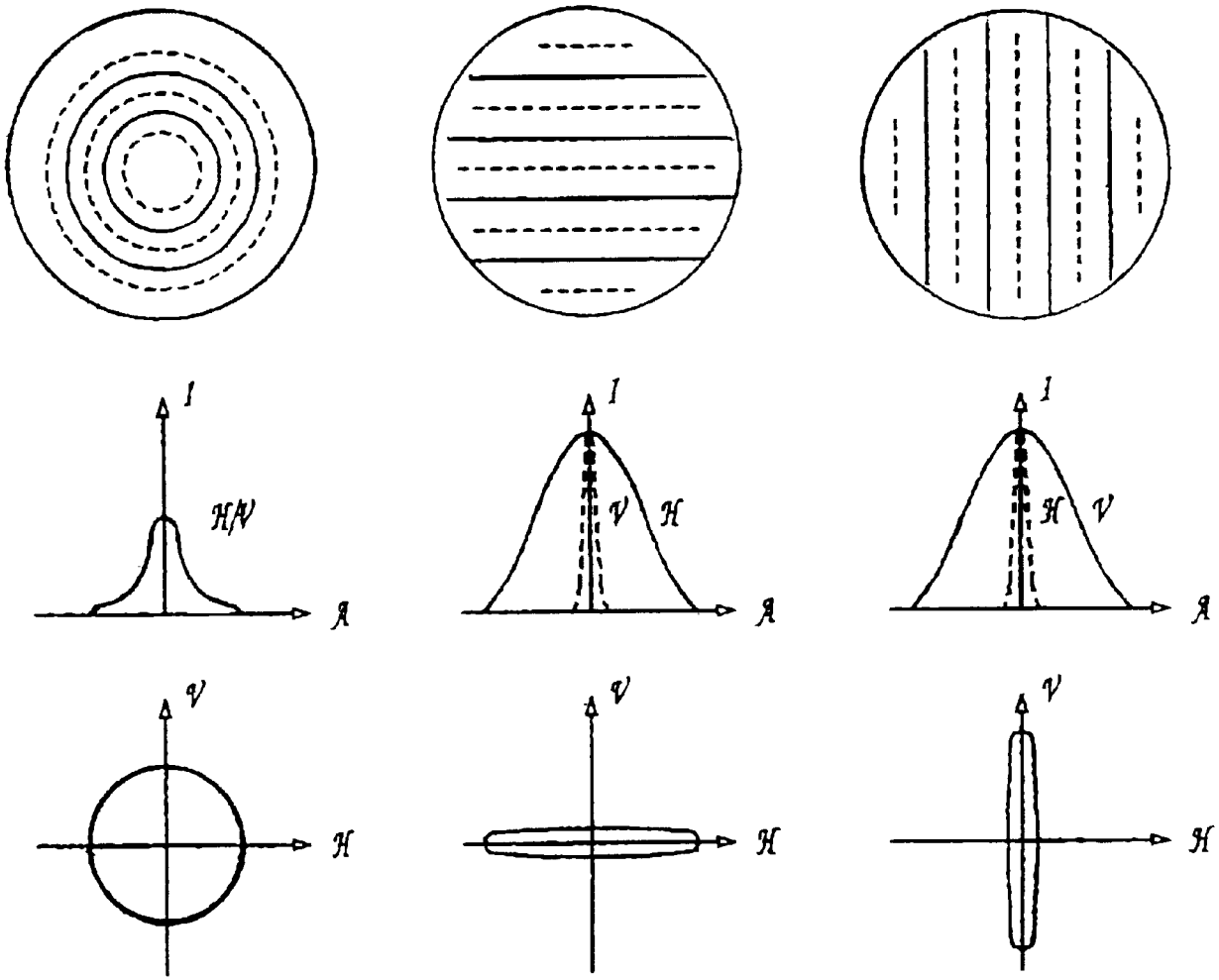
FIG. 4 is a diagram showing light distribution and intensity for circular, horizontal and vertical embodiments of the MCZE.

As shown in FIG. 4, the different MCZE configurations (circular, vertical and horizontal) result in different light distribution patterns with corresponding spatial intensities of the collimated light exiting the MCZE.

Depending on the application, a different MCZE configuration and matching PCB layout may be selected. For example, a railroad application may use a vertical linear MCZE as the required horizontal viewing aspect is very narrow (generally the train track width), while the wide vertical aspect allows viewing of the signal from a wide vertical range, corresponding to viewing locations near and far from the signal at either track or train cab level. Similarly, an automobile traffic signal may be designed with a horizontal linear MCZE to have a wide spread horizontally, across many lanes of traffic. Final tuning of the light distribution is made by the distribution cover 32. Ray tracing computer software allows calculation of very specific optical solutions for both the MCZE 30 and distribution cover 32.

Materials reduction cost savings and increased assembly efficiencies are realized by the snap together housing 10 and distribution cover 32.

Figure 6:
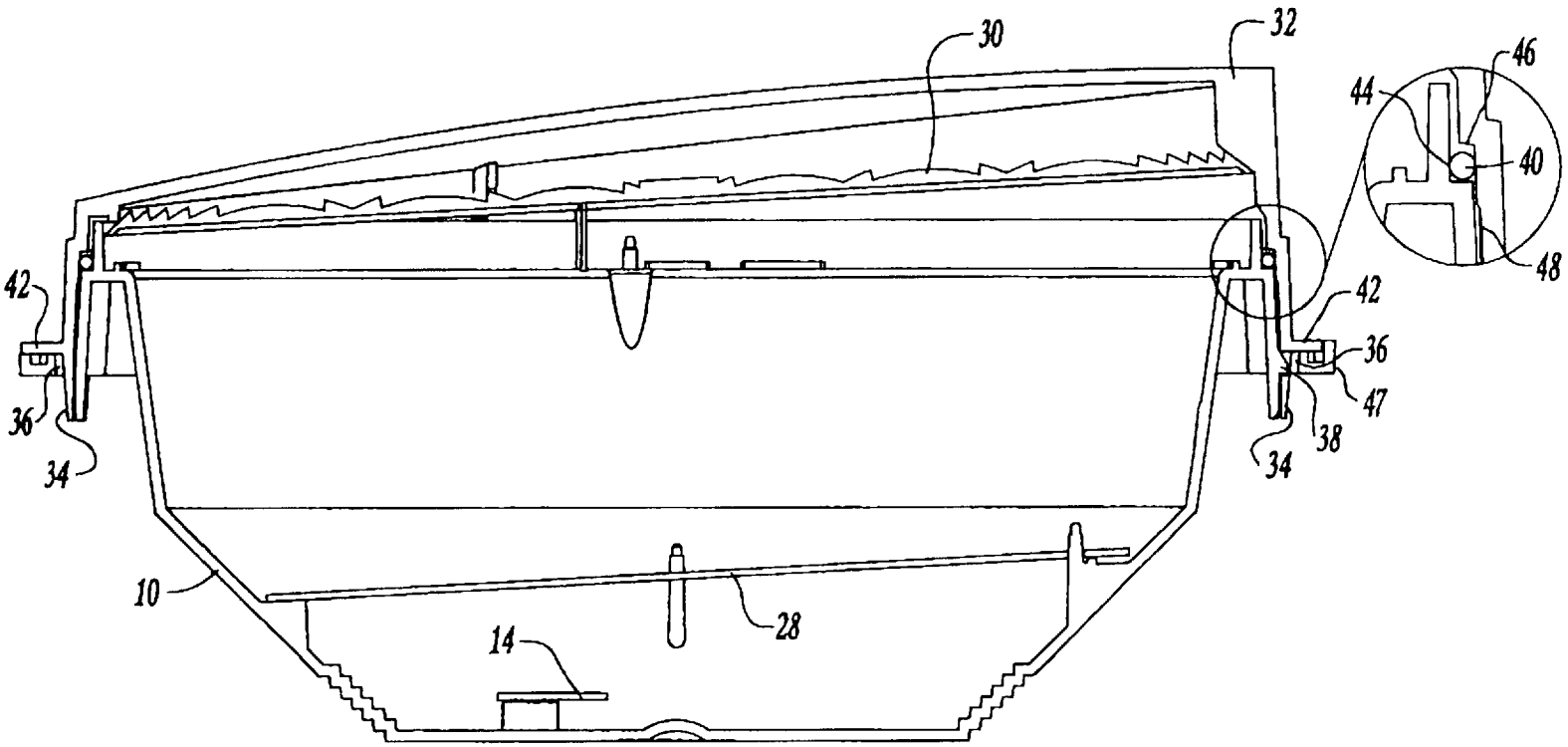
FIG. 6 is a cut-away side view of the 12" embodiment of the invention (electrical components omitted for clarity).
Figure 9:
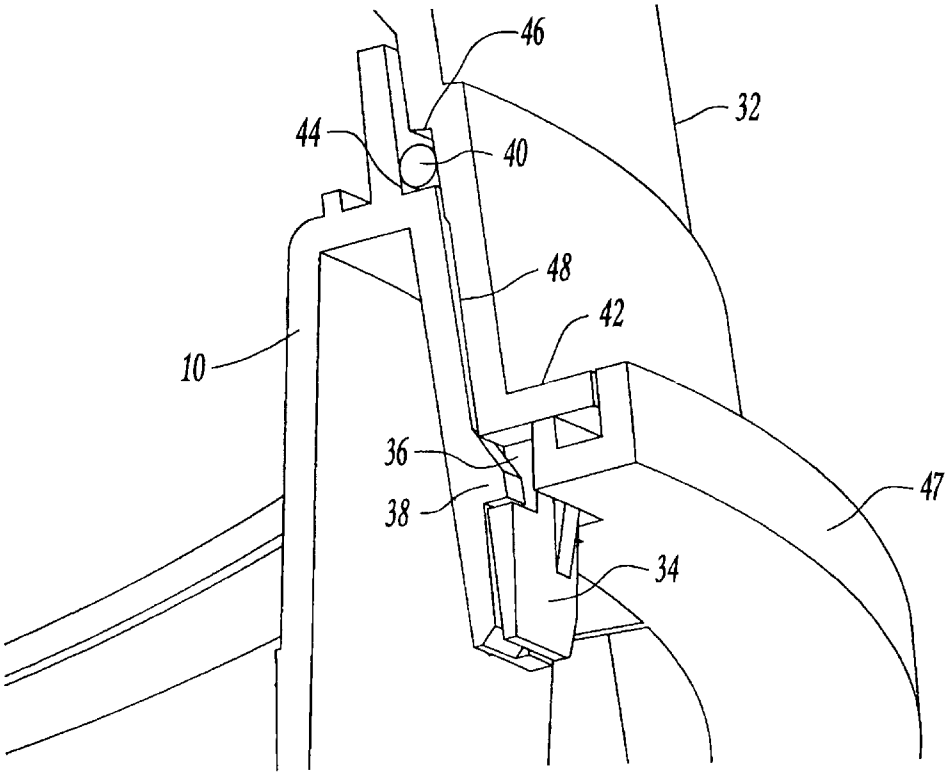
FIG. 9 is a close-up view of the o-ring sealing means and connection tab into tab socket connection means.

As shown in FIG. 6, the distribution cover 32 snap fits into the housing 10. A detailed, close-up view of the connection and sealing means, discussed below, is shown in FIG. 9. Connection tabs 34, arranged around the periphery of distribution cover 32, fit into tab sockets 36. Tab socket keys 38 located proximate the tab sockets 36 lock the connection tabs 34 in place upon insertion. The mating point between the tab socket key 38 and a corresponding hole in the connection tab 34 is arranged and configured to retain the distribution cover 32 at the location where the DC foot 42 bottoms against the housing 10. One connection tab 34 and corresponding tab socket 36 are slightly wider than the others, thereby allowing assembly of the distribution cover 32 and housing 10 in only a single, proper, orientation.

A dust and water resistant seal is provided by o-ring 40. The o-ring 40, preferably made of EDAM material, is sized to elastically fit upon housing shoulder 44. Distribution cover 32 has a primary radius 48 which allows the distribution cover 32 and housing 10 to be initially loosely fitted together, aligned by the connection tabs 34 fitting into tab sockets 36. A final snap fit bottoms DC foot 42 against the housing 10, engages the tab socket keys 38 to the corresponding holes in connection tabs 34 and seats o-ring 40 between housing shoulder 44 and cover shoulder 46. In addition to providing the closure seal between the distribution cover 32 and housing 10, the o-ring 40 provides a shock dissipation function for impacts upon the distribution cover during use.

Power may be supplied to the traffic signal via main power wires 49. The main power wires 49, having the ends stripped to expose the bare conductor, fit into holes in the outside surface of the power terminals 12. The fit of the main power wires 49 into the power terminals 12 is loose. Electrical contact between the main power wires 49 and power terminals 12 is insured by the use of main power connector covers 45. With the main power wires 49 inserted into the power terminals 12 the main power connector covers 45 are friction fit into the holes thereby retaining the main power wires 49 in electrical contact with power terminals 12. The main power connector covers 45 have a cover extending along the main power wires 49 in the down direction, thereby shedding any moisture which may collect or be moving across the back of the housing 10. The main power wires, as shown in FIG. 1, may connect to a standard incandescent lamp socket using an incandescent lamp socket plug 50.

Figure 3:
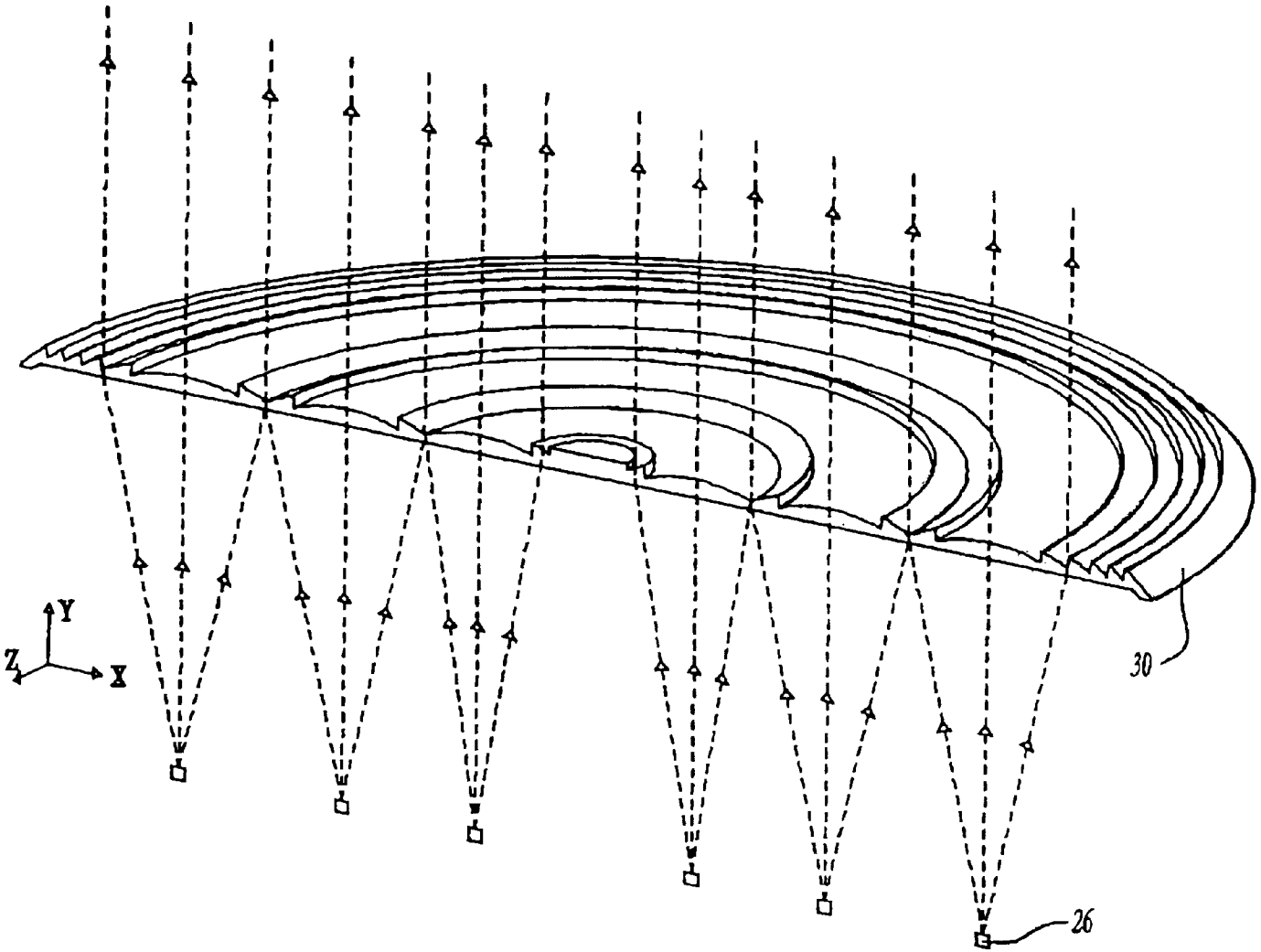
FIG. 3 is a cross section of a circular embodiment of the MCZE showing LED light ray pattern distribution to the collimating zones.
Figure 7:
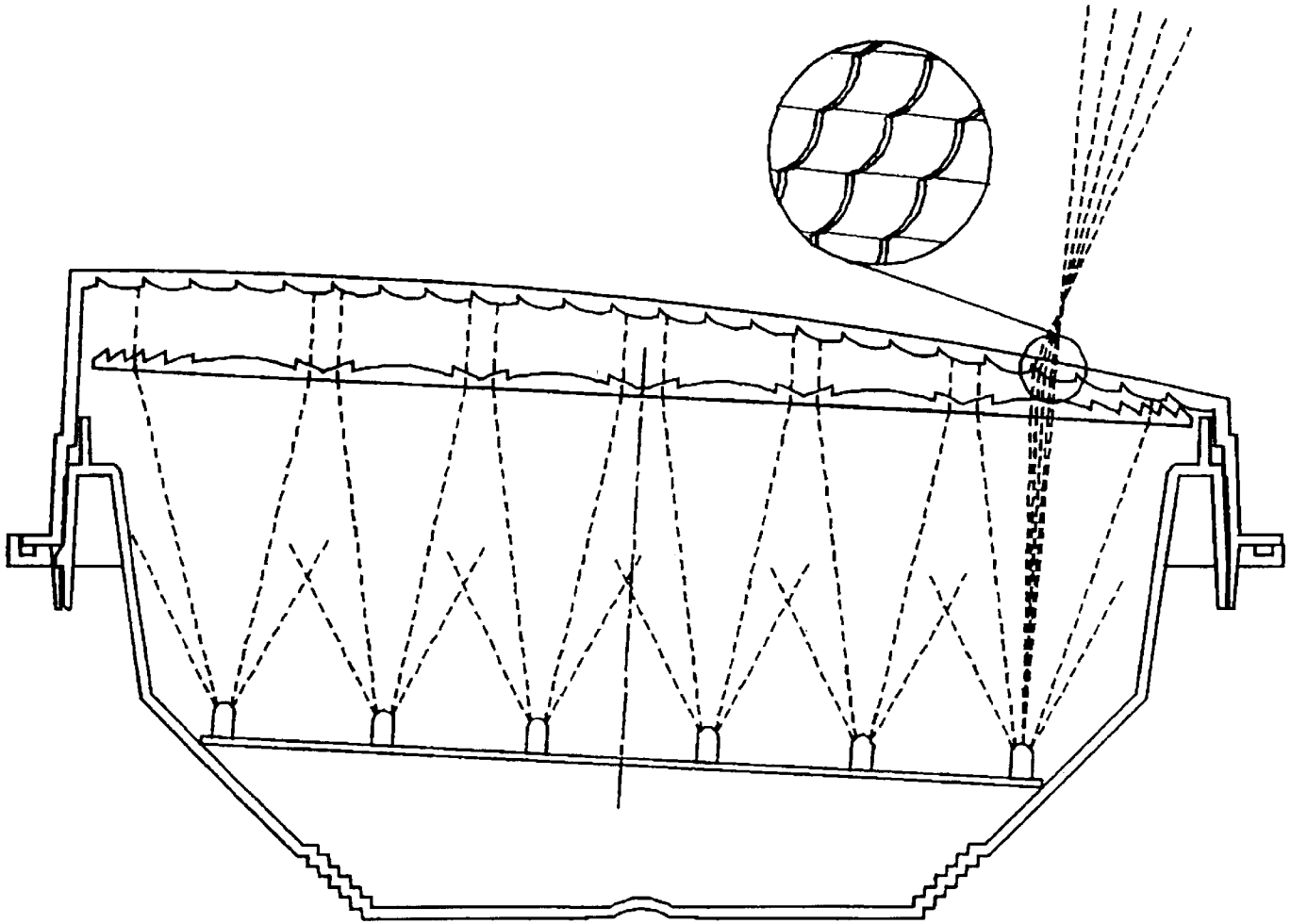
FIG. 7 is a cut-away side view of the 12" embodiment of the invention (electrical and interior components omitted for clarity), showing a ray diagram between the LEDs and the distribution cover and an example of the distribution covers optical effect.
Figure 10:
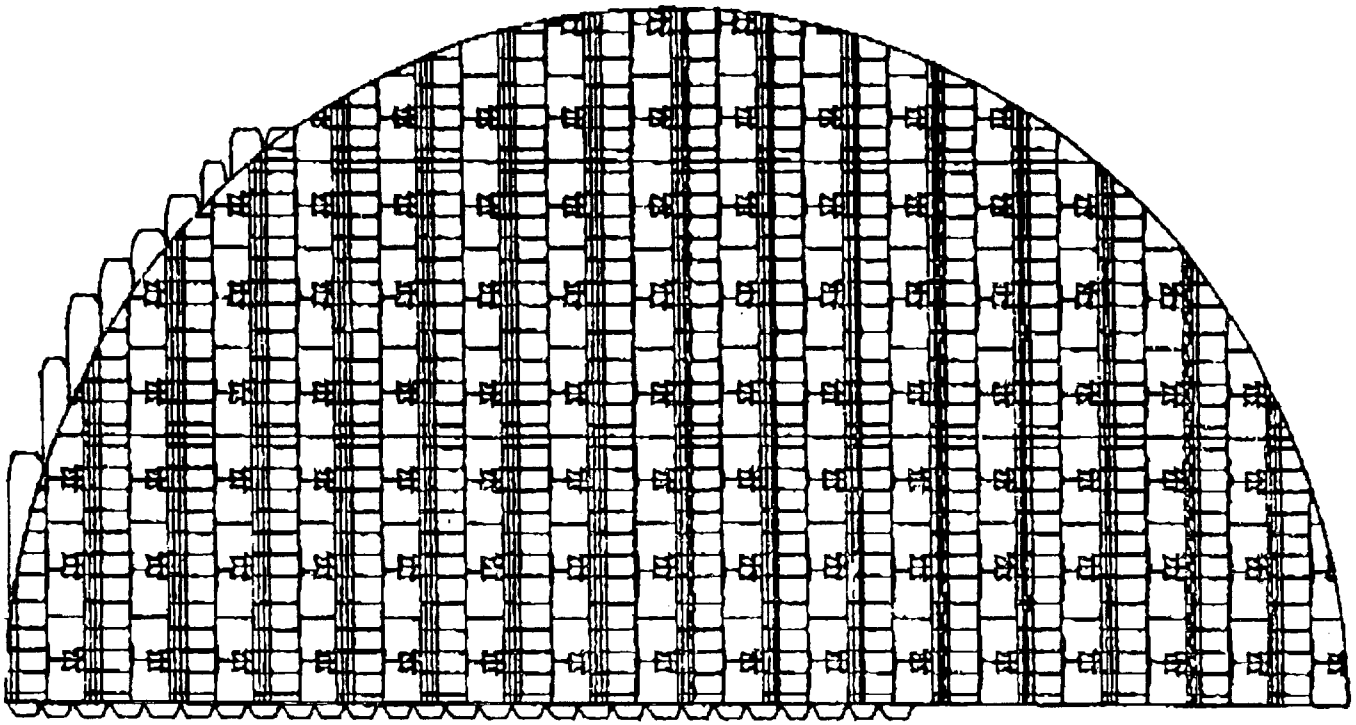
FIG. 10 is a three dimensional view of one-half of the back side of the distribution cover, detailing the compound optical correction surfaces.
Figure 11:
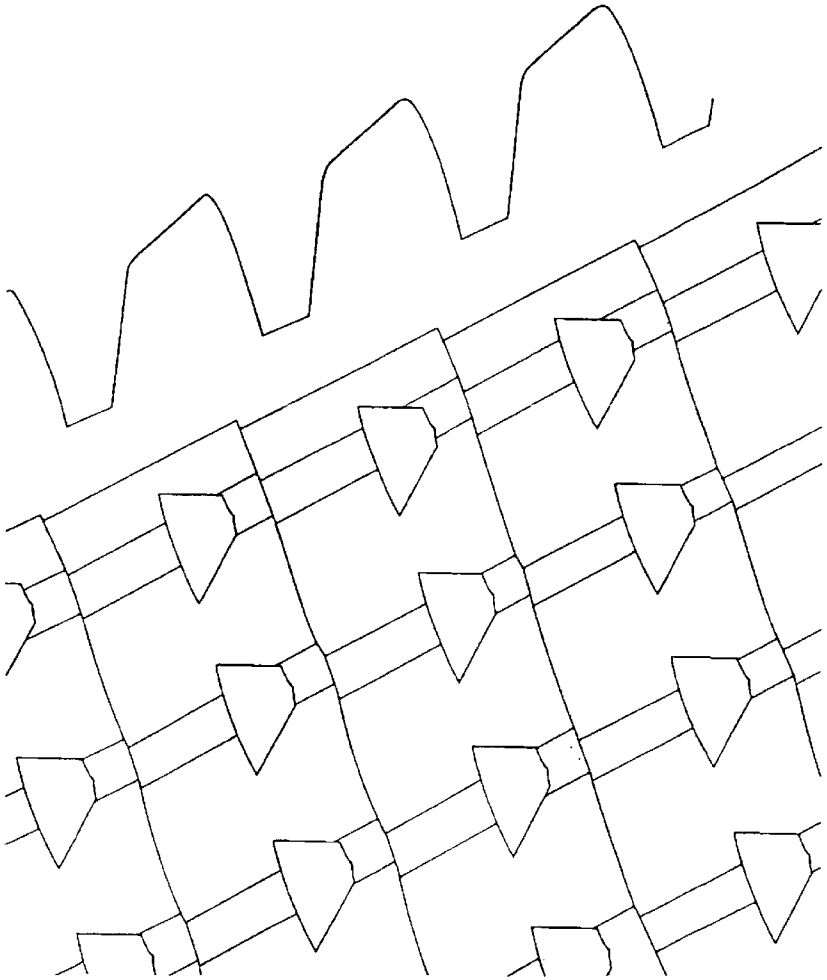
FIG. 11 is a close-up three dimensional view of the optical correction surfaces of FIG. 10.
Figure 12:
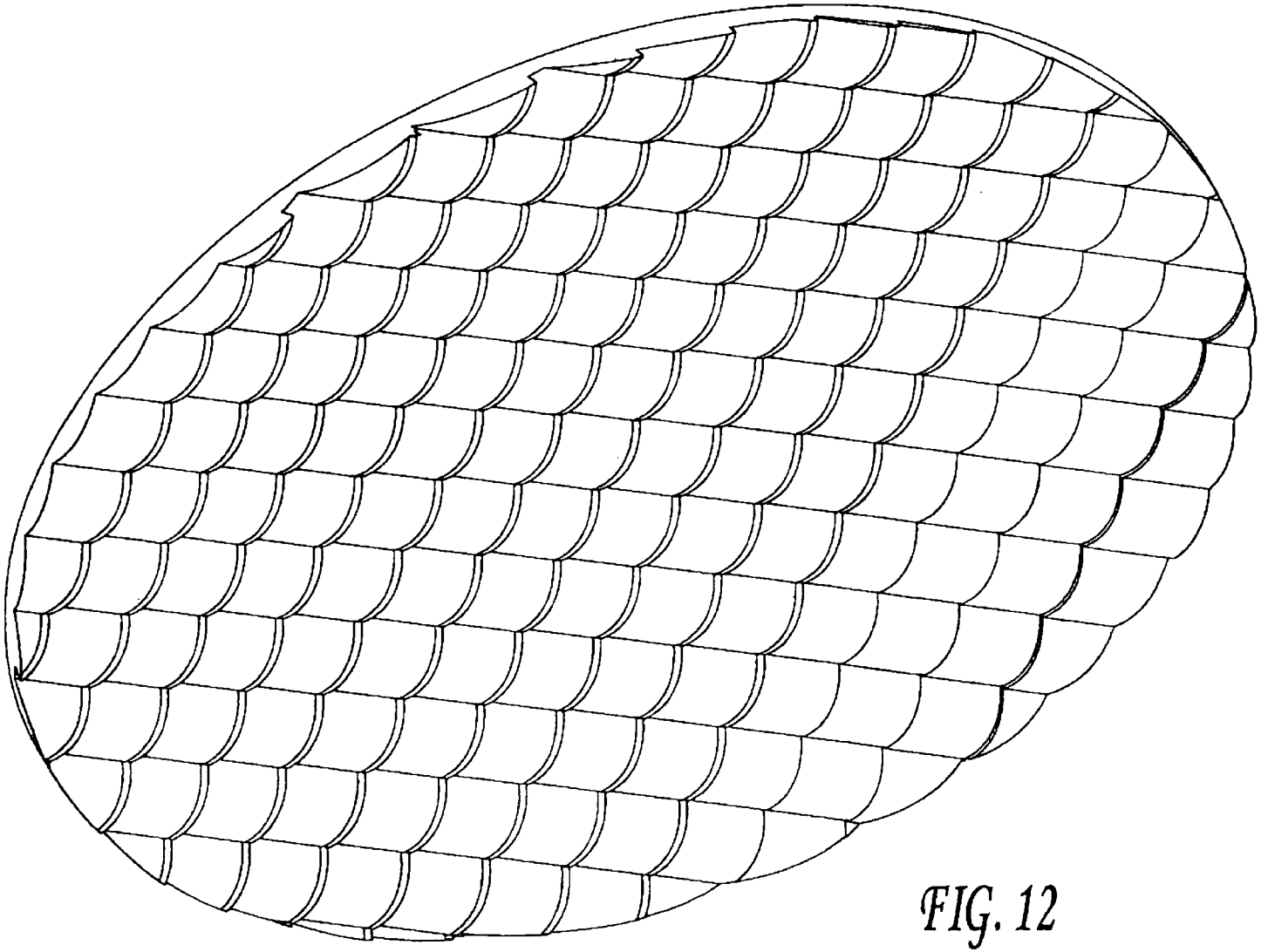
FIG. 12 is a three dimensional view of another embodiment of the back side of the distribution cover, detailing the optical correction surfaces.

As shown by FIG. 3, the calculation of the pattern of the MCZE 30, preferably made of acrylic material, with respect to the PCB 28 and the location of the LEDs 26 thereon is very precise. Taking into account the constraints of the size of the housing 10, allowing it to fit within existing signal openings, the distance between the PCB 28 and the MCZE 30 is made as large as possible. Then, taking into account the angle of light emitted from the LEDs 26 a pattern of concentric circles or linear rows is formed on the PCB 28 to cover the surface of the MCZE 30 fully with LED light. The MCZE 30 has multiple circular or linear collimating zones arranged matching the concentric circles or linear rows of LEDs 26 on the PCB 28. Each circular or linear collimating zone collimates the light emanating from its respective LED 26 ring or linear rows. As shown in FIG. 7, the LED light patterns slightly overlap within and between the rings or rows thus preventing the appearance of shadows, lines, or rings. Due to the overlap, individual LED 26 failure, or variation in LED 26 output between adjacent LEDs 26 will not be discernable by the viewer. At the outer edge of the MCZE 30, fringe elements collect spurious light from within the housing and collimate it in a forward direction. The end result of the combination of the PCB 28 having LEDs 26 and matching patterned collimating elements of the MCZE 30 is to produce a full pattern of collimated light emitted from the MCZE 30 without gaps discernable to the viewer. The collimated light from the MCZE 30 passes next to the distribution cover 32. The distribution cover 32 has a further pattern on its inside surface, shown in FIGS. 10, 11 and in a second embodiment, 12, which directs the collimated light into a final distribution pattern optimized for viewing at the normal design distance from the front of the signal.

Figure 5:
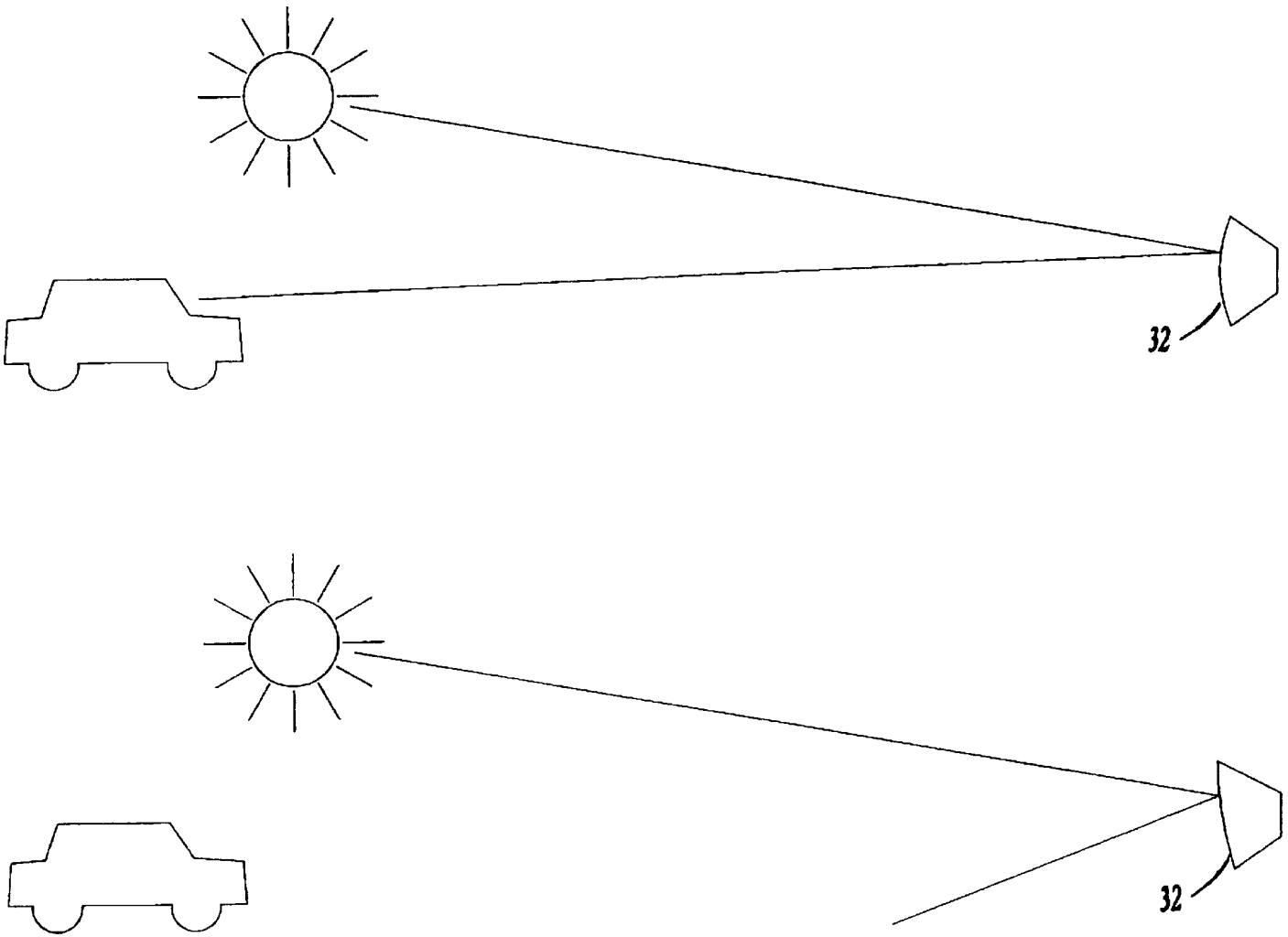
FIG. 5 is a diagram demonstrating the "sun phantom" effect.

The "sun phantom" effect is minimized in the present invention by the use of a large radius (more than 24" radius for the 12" embodiment and more than 18" radius for the 8" embodiment) outer surface of the distribution cover 32. The large radius also simplifies the optical solution for the pattern on the back of the distribution cover. The outer surface of the distribution cover 32 is aligned at an angle inclined towards the ground. As shown by FIG. 5, this has the effect as compared to a conventional forward facing small radius spherical lens traffic signal of reflecting any sun light or other light source towards the ground rather than back towards the viewing position intended for the signal. A problem of LED signals in the past has been that external light sources reflecting into the signal encountering the LEDs which have a highly reflective back surface which could create a noticeable "sun phantom" effect. In the present invention the increased distance between the LEDs 26 and the outer surface of the distribution cover 32 minimizes the chance for internal reflection resulting in a "sun phantom" effect. Further the back face of distribution cover 32 is designed to again direct any external light source to the ground rather than back to the intended viewing position of the traffic signal.

Figure 13:
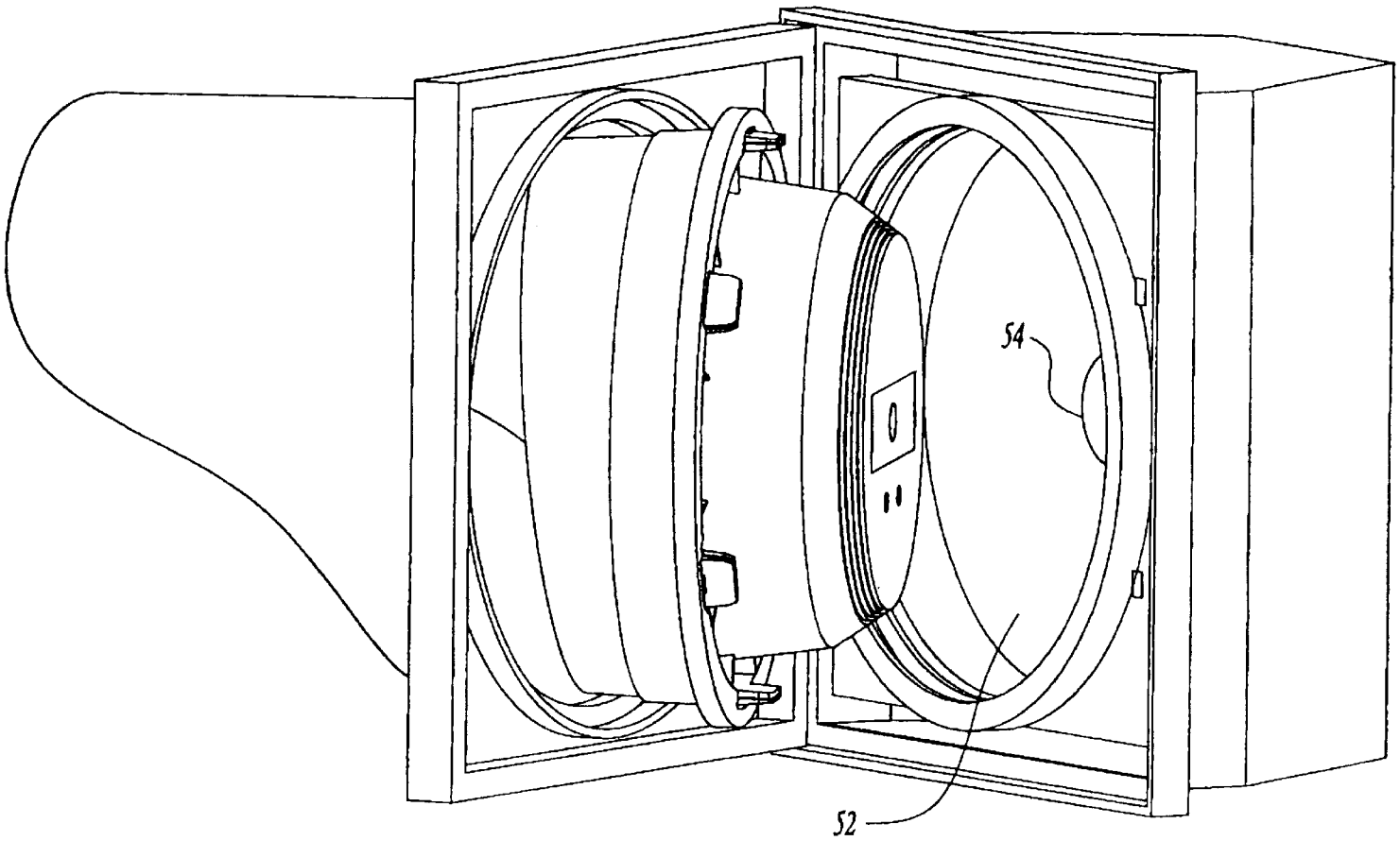
FIG. 13 is a view of a typical traffic signal housing, showing retrofitting of the present invention, replacing the original outer lens and incandescent lamp.

As shown in FIG. 13, the present invention may be easily retrofitted into an existing traffic signal having an incandescent lamp, optical elements and an incandescent light source reflector 52, upon removal of the original outer lens and incandescent lamp. The housing outer rim 47 may be designed to have the same thickness as the lens it replaces. Power connection of the retrofitted light may be performed, without requiring an electrician, by simply screwing the incandescent lamp socket plug 50 into the original incandescent lamp socket 54.

Figure 8:
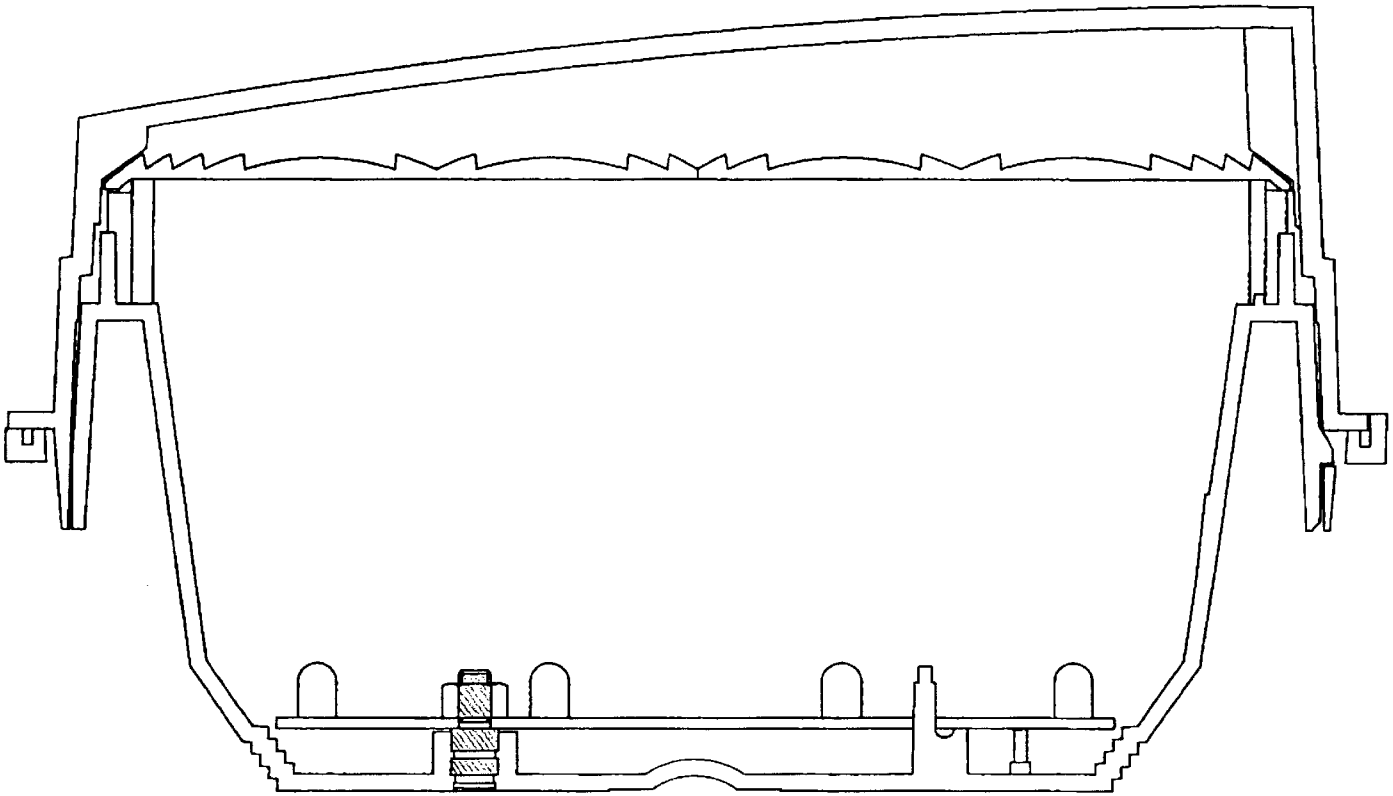
FIG. 8 shows a cut-away view of an 8" embodiment of the invention (power supply components omitted for clarity).

In another embodiment, shown in FIG. 8, the invention is adapted to fit in an existing 8" incandescent traffic signal upon removal only of the incandescent bulb and outer lenses. As space permits, the PCB 28 is not angled and therefore direct connection to power terminals 12 can be made without use of a separate power connector board 14 and power connector cable 18 or power connector spacer 13. The MCZE 30 and inner surface of the distribution cover 32 are optimized for the different LED 26 layout and angles of the PCB 28 and MCZE 30 with respect to the distribution cover 32.

The above invention is optimized for presently available cost effective LED's. As higher output, cost effective LED's become available, fewer LED's will be required to obtain the same light output. Due to the overlapping output of the present LEDs, when higher output LEDs become available, modification of only the LED spacing on the PCB is required.

If output of the LEDs increases beyond the point where placement of fewer LEDs in the concentric rings or linear rows still results in overlap, then only the MCZE need be recalculated. The distribution cover is independent of the light source as it receives an even distribution of collimated light from the MCZE for final distribution to the viewer.

A family of signal devices may be created from the present invention using common components. Different distribution covers, creating different distribution patterns may be snap fitted onto a common housing with standardized PCB and MCZE. Information and/or directional signals may be created by masking portions of the distribution cover into, for example, turn signal arrows.

A variation of the housing, using otherwise similar components may be used to create stand alone signals or even general illumination light sources useful, for example, when it is foreseen that the light source will be located where maintenance will be difficult and an extreme service interval is desired.

Further, although particular components and materials are specifically identified herein, one skilled in the art may readily substitute components and/or materials of similar function without departing from the invention as defined in the appended claims.

The present invention is entitled to a range of equivalents, and is to be limited only by the following claims.

I claim:

1. A LED signal comprising:

a housing having an interior area, a plurality of LEDs, a collimating element having collimating zones, and a distribution cover having a light transmission surface;

said plurality of LEDs arranged in rings and/or lines within said interior area of said housing, said collimating element arranged between said LED and said distribution cover, said collimating zones arranged to correspond to the arrangement of the LEDs, and said housing and said distribution cover having means for attachment which attaches said distribution cover to said housing, wherein said signal is a 12" nominal size, and said light transmission surface has a spherical shape having an arc radius greater than 24".

2. A LED signal comprising:

a housing having an interior area, a plurality of LEDs, a collimating element having collimating zones, and a distribution cover having a light transmission surface;

said plurality of LEDs arranged in rings and/or lines within said interior area of said housing, said collimating element arranged between said LED and said distribution cover, said collimating zones arranged to correspond to the arrangement of the LEDs, and said housing and said distribution cover having means for attachment which attaches said distribution cover to said housing, wherein said signal is a 8" nominal size, and said light transmission surface has a spherical section having an arc radius greater than 18".

3. A LED signal comprising:

a housing having an interior area, at least one LED mounted on a first side of a PCB arranged within said interior area of said housing, also housing a power supply circuit on said first side, a collimating element, and a distribution cover having a light transmission surface;

said collimating element arranged between said PCB and said distribution cover.

4. The LED signal of claim 3, wherein said light transmission surface is angled with respect to a reference plane normal to a light emission centerline of the at least one LED.

5. The LED signal of claim 4, wherein said means for attachment is at least one tab mateable to a corresponding socket.

6. The LED signal of claim 3, wherein said means for attachment is at least one tab mateable to a corresponding socket.

7. The LED signal of claim 3, further including sealing means to environmentally seal said LED signal.

8. A LED signal comprising:

a housing having an interior area, a plurality of LEDs mounted on a first side of a PCB arranged within said interior area of said housing, and said housing and a distribution cover having means for attachment which attaches said distribution cover to said housing, and said distribution cover having a light transmission surface;

a collimating element arranged between said PCB and said distribution, cover said collimating element having collimating zones;

said LEDs arranged in rings and/or lines; and said collimating zones arranged to correspond to the arrangement of LEDs, wherein said means for attachment is at least one tab mateable to a corresponding socket.

9. A LED signal comprising:

a housing having an interior area, at least one LED, a collimating element, and a distribution cover having a light transmission surface;

said at least one LED arranged within said interior area of said housing, said collimating element arranged between said LED and said distribution cover, said housing and said distribution cover having means for attachment which attaches said distribution cover to said housing, wherein said means for attachment is at least one tab mateable to a corresponding socket.

10. The LED signal of claim 9, further including sealing means to environmentally seal said LED signal.

11. The LED signal of claim 10, wherein said sealing means is an O-ring.

12. A LED signal comprising:

a housing having an interior area, at least one LED, a collimating element, and a distribution cover having a light transmission surface;

said at least one LED arranged within said interior area of said housing, said collimating element arranged between said LED and said distribution cover, said housing and said distribution cover having means for attachment which attaches said distribution cover to said housing, wherein said at least one LED are electronically interconnected by mounting upon a first side of a PCB further including LED power supply electrical components and circuitry on the first side of the PCB.

13. The LED signal of claim 12, wherein said at least one LED are arranged in at least one substantially circular configuration.

14. The LED signal of claim 12, wherein said at least one LED are arranged in at least one substantially linear configuration.

15. The LED signal of claim 12, wherein said collimating element includes collimating zones arranged and configured with respect to the distribution of said LEDs on said PCB.

16. The LED signal of claim 15, wherein said collimating zones are arranged in concentric circles.

17. The LED signal of claim 12, wherein said signal is a 12" nominal size, and said light transmission surface has a spherical shape having an arc radius greater than 24".

18. The LED signal of claim 12, wherein said signal is a 8" nominal size, and said light transmission surface has a spherical section having an arc radius greater than 18".

19. The LED signal of claim 12, wherein said light transmission surface is flat.

20. The LED signal of claim 12, wherein said light transmission surface is angled with respect to a reference plane normal to a light emission centerline of the at least one LED.

* * * * *